US005169461A

United States Patent [19]

Watwe et al.

[11] Patent Number: 5,169,461

[45] Date of Patent: * Dec. 8, 1992

[54] HIGH TEMPERATURE ALUMINUM-BASE ALLOY

[75] Inventors: Arunkumar S. Watwe, Huntington, W. Va.; Prakash K. Mirchandani, Troy, Mich.; Walter E. Mattson, Huntington, W. Va.

[73] Assignee: Inco Alloys International, Inc., Huntington, W. Va.

[ * ] Notice: The portion of the term of this patent subsequent to Dec. 15, 2009 has been disclaimed.

[21] Appl. No.: 711,633

[22] Filed: Jun. 6, 1991

Related U.S. Application Data

[63] Continuation-in-part of Ser. No. 615,776, Nov. 19, 1990.

[51] Int. Cl.[5] ..... C22C 21/00; B22F 9/00

[52] U.S. Cl. ..... 148/437; 75/249; 148/438; 148/439; 148/440; 420/528; 420/529

[58] Field of Search ..... 75/249; 148/437, 438, 148/439, 440; 420/528, 529

[56] References Cited

U.S. PATENT DOCUMENTS 4,668,470 5/1987 Gilman et al. ..... 419/32
4,834,810 5/1989 Benn et al. ..... 148/437

FOREIGN PATENT DOCUMENTS 0340789 11/1989 European Pat. Off. .

*Primary Examiner*—R. Dean
*Assistant Examiner*—Robert R. Koehler
*Attorney, Agent, or Firm*—Blake T. Biederman; Edward A. Steen

[57] ABSTRACT

The alloy of the invention has improved intermediate temperature properties at temperatures up to about 482° C. The alloy contains (by weight percent) a total of about 6–12% X contained as an intermetallic phase in the form of $Al_3X$. X is selected from the group consisting of Nb, Ti and Zr. The alloy also contains about 0.1–4% strengthener selected from the group consisting of Co, Cr, Mn, Mo, Ni, Si, V, Nb when Nb is not selected as X and Zr when Zr is not selected as X. In addition, the alloy contains about 1–4% C and about 0.1–2% O.

12 Claims, 2 Drawing Sheets

HIGH TEMPERATURE ALUMINUM-BASE ALLOY

This is continuation-in-part of copending application Ser. No. 07615,776 filed on Nov. 19, 1990.

FIELD OF INVENTION

This invention relates to mechanical alloyed (MA) aluminum-base alloys. In particular, this invention relates to MA aluminum-base alloys strengthened with an $Al_3X$ type phase dispersoid for applications requiring engineering properties at temperatures up to about 482° C.

BACKGROUND OF THE INVENTION

Aluminum-base alloys have been designed to achieve improved intermediate temperature (ambient to about 316° C.) and high temperature (above about 316° C.) for specialty applications such as aircraft components. Properties critical to improved alloy performance include density, modulus, tensile strength, ductility, creep resistance and corrosion resistance. To achieve improved properties at intermediate and high temperatures, aluminum-base alloys, have been created by rapid solidification, strengthened by composite particles or whiskers and formed by mechanical alloying. These methods of forming lightweight elevated temperature alloys have produced products with impressive properties. However, manufacturers, especially manufacturers of turbine engines, are constantly demanding increased physical properties wtih decreased density and increased modulus at increased temperatures. Specific modulus of an alloy directly compares modulus in relation to density. A high modulus in combination with a low density produces a high specific modulus.

Examples of aluminum-base rapid solidification alloys are disclosed in U.S. Pat. Nos. 4,743,317 ('317) and 4,379,719 ('719). Generally, the problems with rapid solidification alloys include limited liquid solubility, increased density and limited mechanical properties. For example, the rapid solidification Al-Fe-X alloys of the '317 and '719 patents have increased density arising from the iron and other relatively high density elements. Furthermore, Al-Fe-X alloys have less than desired mechanical properties and coarsening problems.

An example of a mechanical alloyed composite stiffened alloy was disclosed by Jatkar et al. in U.S. Pat. No. 4,557,893. The MA aluminum-base structure of Jatkar et al. produced a product with superior properties to the Al-Fe-X rapid solidification alloys. However, an increased level of skill is required to produce such composite materials and a further increase in alloy performance would result in substantial benefit to turbine engines.

A combination rapid solidification and MA aluminum-titanium alloy, having 4–6% Ti, 1–2% C and 0.1–0.2% O, is disclosed by Frazier et al. in U.S. Pat. No. 4,834,942. For purposes of the present specification, all component percentages are expressed in weight percent unless specifically expressed otherwise. The alloy of Frazier et al. has lower than desired physical properties at high temperatures. Previous MA Al-Ti alloys have been limited to a maximum practical engineering operating temperature of about 316° C.

It is an object of this invention to provide an aluminum-base alloy that facilitates simplified alloy formation as compared to aluminum-base alloys produced using rapid solidification.

It is a further object of this invention to produce an aluminum-base MA alloy having improved high temperature properties, increased upper temperature limits, and an increased specific modulus.

SUMMARY OF THE INVENTION

The invention consists of an alloy having improved intermediate and high temperature properties at temperatures up to about 482° C. The alloy contains (by weight percent) a total of about 6–12% X contained as an intermetallic phase in the form of $Al_3X$. X is selected from the group consisting of Nb, Ti and Zr. The alloy also contains a total of 0.1–4% strengthener selected from at least one of the group consisting of Co, Cr, Mn, Mo, Ni, Si, V, Nb when Nb is not selected as X and Zr when Zr is not selected as X. In addition, the alloy contains about 1–4% C and and about 0.1–2% O.

DESCRIPTION OF PREFERRED EMBODIMENT

Figure 1:
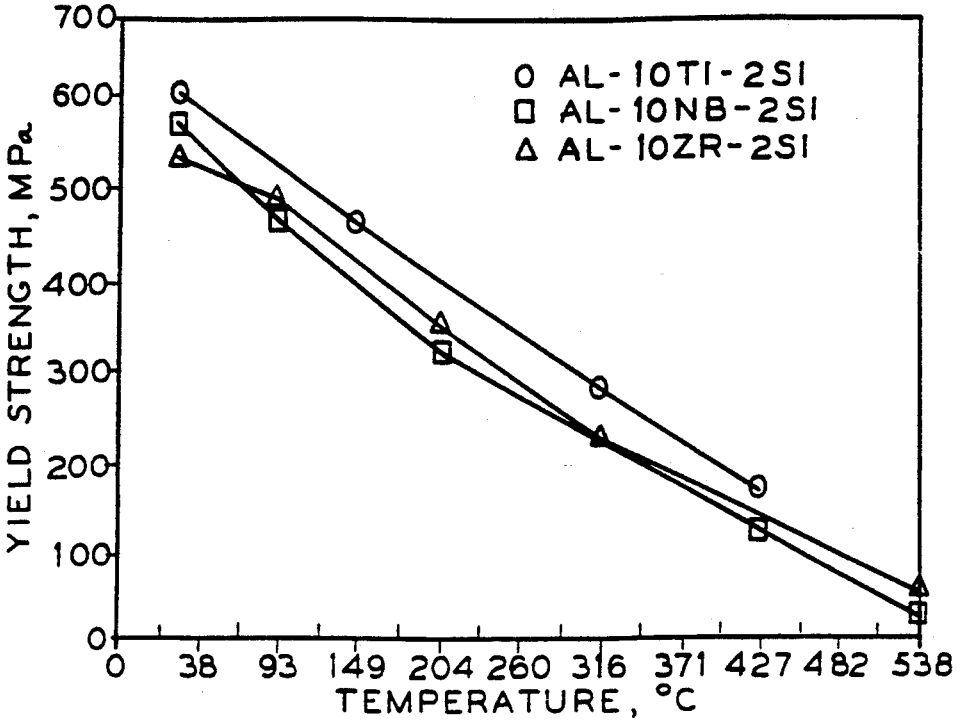
FIG. 1 is a plot of yield strength of MA Al-10(Ti, Nb or Zr)-2Si alloys at temperatures between 24° and 538° C.

The aluminum-base MA alloys of the invention provide excellent engineering properties for applications having relatively high operating temperatures up to about 482° C. The aluminum-base alloy is produced by mechanically alloying aluminum and strengthener with one or more elements selected from the group of Nb, Ti and Zr. In mechanical alloying, master alloy powders or elemental powders formed by liquid or gas atomization may be used. An $Al_3X$ type phase is formed with Nb, Ti and Zr. These $Al_3X$ type intermetallics provide strength at elevated temperatures because these $Al_3X$ type intermetallics have high stability, a high melting point and a relatively low density. In addition, Nb, Ti and Zr have low diffusivity at elevated temperatures. The MA aluminum-base alloy is produced by mechanically alloying elemental or intermetallic ingredients as previously described in U.S. Pat. Nos. 3,740,210; 4,600,556; 4,623,388; 4,624,704; 4,643,780; 4,668,470; 4,627,959; 4,668,282; 4,557,893 and 4,834,810. The process control agent is preferably an organic material such as organic acids, alcohols, heptanes, aldehydes and ethers. Most preferably, process control aids such as stearic acid, graphite or a mixture of stearic acid and graphite are used to control the morphology of the mechanically alloyed powder. Preferably, stearic acid is used as the process control aid.

Powders may be mechanically alloyed in any high energy milling device with sufficient energy to bond powders together. Specific milling devices include attritors, ball mills and rod mills. Specific milling equipment most suitable for mechanically alloying powders of the invention includes equipment disclosed in U.S. Pat. Nos. 4,603,814, 4,653,335, 4679,736 and 4,887,773.

The MA aluminum-base alloy is strengthened primarily with $Al_3X$ intermetallics and a dispersion of aluminum oxides and carbides. The $Al_3X$ intermetallics may be in the form of particles having a grain size about equal to the size of an aluminum grain or be distributed throughout the grain as a dispersoid. The aluminum oxide ($Al_2O_3$) and aluminum carbide ($Al_4C_3$) form dispersions which stabilize the grain structure. The MA aluminum-base alloy may contain a total of about 6–12% X, wherein X is selected from Nb, Ti and Zr and any combination thereof. In addition, the alloy contains about 1–4% C and about 0.1–2% O and most preferably contains about 0.7–1% O and about 1.2–2.3% C for grain stabilization. In addition, for increased matrix stiffness, the MA aluminum-base alloy preferably contains a total of about 8–11% X.

It has also been discovered that a "ternary" addition of Co, Cr, Mn, Mo, Nb, Ni, Si, V or Zr or any combination thereof may be used to increase tensile properties from ambient to intermediate temperatures. It is recognized that the ternary alloy contains carbon and oxygen in addition to aluminum, (titanium, niobium or zirconium) and a ternary strengthener. Preferably, about 1–3% Si is added to improve properties up to about 316° C. Most preferably, the strengthener is about 2% Si.

EXAMPLE 1

A series of alloys were prepared to compare the effects of Nb, Ti and Zr. Elemental powders were used in making the ternary alloys. The powders were charged with 2.5% stearic acid in an attritor. The charge was then milled for 12 hours in an atmosphere constantly purged with argon. The milled powders were then canned and degassed at 493° C. under a vacuum of 50 microns of mercury. The canned and degassed powder was then consolidated to 9.2 cm diameter billets by upset compacting against a blank die in a 680 tonne extrusion press. The canning material was completely removed and the billets were then extruded at 371° C. to 1.3 cm×5.1 cm bars. The extruded bars were then tested for tensile properties. All samples were tested in accordance with ASTM E8 and E21. The tensile properties for the Al-10(Ti, Nb or Zr)-2Si alloy series are given below in Table 1.

TABLE 1

| Test Temp. (°C.) | U.T.S. (MPa) | Y.S. (MPa) | Elong. (%) | R.A. (%) |
|---|---|---|---|---|
| | MA Al—10Ti—2Si | | | |
| 24 | 647 | 611 | 3.0 | 4.7 |
| 149 | 476 | 461 | 3.0 | 8.7 |
| 316 | 285 | 277 | 4.0 | 7.1 |
| 427 | 165 | 160 | 9.0 | 18.2 |
| | MA Al—10Nb—2Si | | | |
| 24 | 685 | 574 | 4.0 | 7.0 |
| 93 | 479 | 478 | 5.0 | 20.0 |
| 204 | 331 | 325 | 2.0 | 10.0 |
| 427 | 133 | 121 | 1.0 | 13.0 |
| 538 | 30 | 20 | 5.0 | 8.0 |
| | MA Al—10Zr—2Si | | | |
| 24 | 618 | 537 | 9.5 | 7.0 |
| 93 | 492 | 490 | 5.5 | 14.5 |
| 204 | 352 | 351 | 2.0 | 10.0 |
| 315 | 230 | 226 | 3.0 | 18.5 |
| 538 | 50 | 48 | 1.0 | 2.0 |

Figure 2:
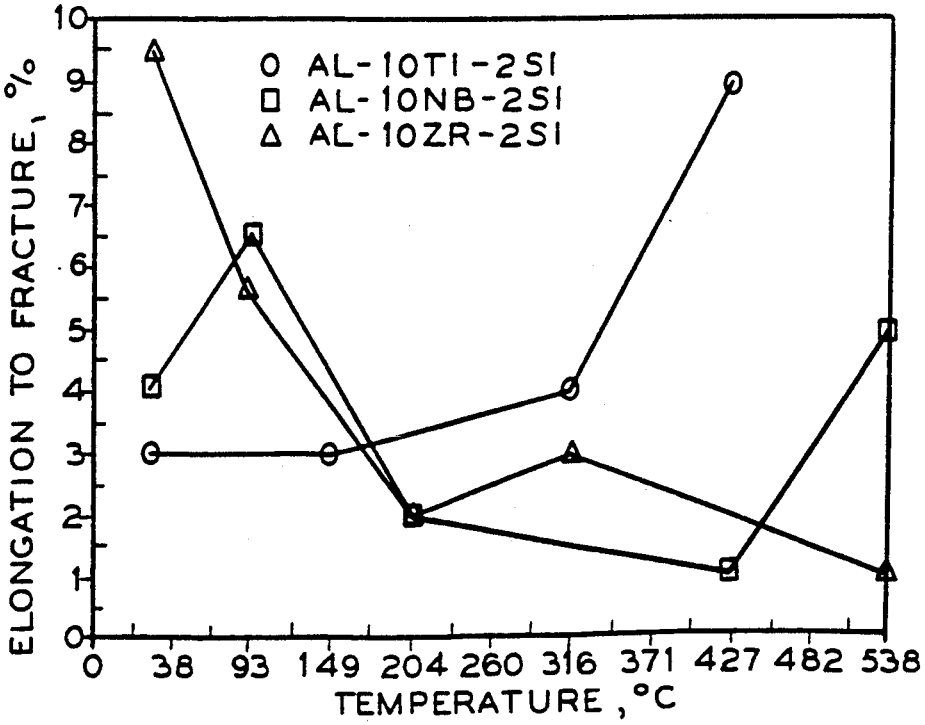
FIG. 2 is a plot of tensile elongation of MA Al-10)Ti, Nb or Zr)-2Si alloys at temperatures between 24° and 538° C.

A plot of the Ti/Nb/Zr series yield strength is given in FIG. 1 and tensile elongation is given in FIG. 2. Table 1 and FIGS. 1 and 2 show that an equal weight percent of Nb or Zr provide lower yield strength at ambient and elevated temperatures. Ductility levels of (10Nb or 10Zr)-2Si generally decrease to about 427° C. and ductility levels of Al-10Ti-2Si generally increase with temperature.

The solid solubilities of titanium, niobium and zirconium in aluminum, the density of $Al_3Ti$, $Al_3Nb$ and $Al_3Zr$ intermetallics and the calculated fractions of intermetallic $Al_3Ti$, $Al_3Nb$ and $Al_3Zr$ formed with 10 wt. % Ti, Nb and Zr respectively, are given below in Table 2.

TABLE 2

| Transition Metal | Solubility in Al, wt. % (0–482° C.) | Density of Intermetallic g/cm$^3$ | Volume of Intermetallics, % |
|---|---|---|---|
| Titanium | 0.1 | 3.4 | 22 |
| Niobium | 0.1 | 4.54 | 12 |
| Zirconium | 0.1 | 4.1 | 13 |

Although Al-(10Nb or 10Zr)-2Si alloys contain only about half the amount of $Al_3X$ type intermetallics by volume of Al-10Ti-2Si alloy, the Al-(10Nb or 10Zr)-2Si alloys have only marginally lower strength levels at ambient temperatures. Furthermore, the ductility of Al-10Ti-2Si increases with temperature, whereas that of Al-(10Nb or 10Zr)-2Si decreases to about 427° C. These significant differences in mechanical behavior of these alloys most likely arise from differences in morphology and deformation characteristics of the intermetallics. Mechanical alloying of Nb and Zr with aluminum produces $Al_3Nb$ and $Al_3Zr$ intermetallics randomly distributed throughout an aluminum matrix. The average size of the $Al_3Nb$ and $Al_3Zr$ particles is about 25 nm. It is believed that $Al_3Zr$ and $Al_3Nb$ particles provide Orowan strengthening that is not effective at elevated temperatures. However, $Al_3Ti$ particles have an average size of about 250 nm, roughly the same size as the MA aluminum grains. The larger grained $Al_3Ti$ particles are believed to strengthen the MA aluminum by a different mechanism than $Al_3Nb$ and $Al_3Zr$ particles. These $Al_3Ti$ particles do not strengthen primarily with Orowan strengthening and are believed to increase diffused slip at all temperatures, whereas an absence of diffused slip in alloys containing $Al_3Nb$ or $Al_3Zr$ leads to low ductility at elevated temperatures. A slight difference between the $Al_3Nb$ and $Al_3Zr$ may be attributed to slightly different lattice structures. $Al_3Nb$ and $Al_3Ti$ have a $DO_{22}$ lattice structure and $Al_3Zr$ has a $DO_{23}$ lattice structure. However, the differences in morphology appear to have the greatest effect on tensile properties.

Titanium is the preferred element to use to form an $Al_3X$ type intermetallic. Titanium provides the best combination of ambient temperature and elevated temperature properties. Most preferably, about 8–11% Ti is used. In addition, a combination of Ti and Zr or Nb may be used to optimize the strengthening mechanisms of $Al_3Ti$ and the Orowan mechanism of $Al_3Zr$ and $Al_3Nb$.

EXAMPLE 2

A series of alloys were prepared to compare the effects of "ternary" strengtheners on MAaluminum-titanium alloys. The samples were prepared and tested with the procedure of Example 1. Ternary strengtheners tested were selected from the group consisting of Co, Cr, Mn, Mo, Nb, Si, V and Zr. Table 3 below provides nominal composition and chemical analysis of the ternary strengthened alloys in weight percent.

TABLE 3

| Nominal Composition | Ti | M | C | O |
|---|---|---|---|---|
| Al—10Ti | 9.8 | 0.0 | 1.62 | 0.65 |
| Al—12Ti | 12.1 | 0.0 | 1.58 | 0.62 |
| Al—10Ti—2Mn | 9.8 | 1.9 | 1.52 | 0.51 |
| Al—10Ti—2Cr | 9.8 | 1.82 | 1.6 | 0.6 |
| Al—10Ti—2V | 9.6 | 2.2 | 1.56 | 0.61 |
| Al—10Ti—2Ni | 9.9 | 1.8 | 1.54 | 0.66 |
| Al—10Ti—2Co | 9.9 | 1.9 | 1.51 | 0.61 |
| Al—10Ti—2Nb | 9.7 | 2.01 | 1.6 | 0.55 |
| Al—10Ti—2Mo | 9.9 | 2.0 | 1.53 | 0.55 |
| Al—10Ti—2Zr | 9.64 | 1.29 | 1.85 | 0.64 |
| Al—10Ti—2Si | 9.8 | 1.93 | 1.6 | 0.7 |

Tensile properties of the ternary strengthened alloys of Table 3 are given below in Table 4.

TABLE 4

| Test Temp. (°C.) | U.T.S. (MPa) | Y.S. (MPa) | Elong. (%) | R.A. (%) |
|---|---|---|---|---|
| | | Al—10Ti | | |
| 24 | 488 | 423 | 14.0 | 26.1 |
| 149 | 361 | 352 | 7.5 | 14.1 |
| 316 | 201 | 192 | 5.5 | 12.0 |
| 427 | 121 | 117 | 11.0 | 19.4 |
| | | Al—12Ti | | |
| 24 | 510 | 451 | 8.0 | 13.0 |
| 149 | 369 | 351 | 3.9 | 8.5 |
| 316 | 214 | 205 | 3.2 | 8.0 |
| 427 | 125 | 124 | 10.0 | 16.5 |
| | | Al—10Ti—2Mn | | |
| 24 | 565 | 513 | 5.4 | 5.3 |
| 149 | 439 | 413 | 1.3 | 2.4 |
| 316 | 209 | 199 | 3.2 | 9.9 |
| 427 | 119 | 110 | 9.0 | 19.9 |
| | | Al—10Ti—2Cr | | |
| 24 | 483 | 404 | 5.4 | 6.8 |
| 149 | 337 | 320 | 4.1 | 7.2 |
| 316 | 205 | 194 | 3.1 | 10.5 |
| 427 | 121 | 108 | 12.4 | 22.4 |
| | | Al—10Ti—2V | | |
| 24 | 582 | 525 | 3.6 | 9.4 |
| 149 | 445 | 412 | 2.7 | 7.9 |
| 316 | 228 | 223 | 6.5 | 18.0 |
| 427 | 130 | 122 | 8.9 | 21.6 |
| | | Al—10Ti—2Ni | | |
| 24 | 715 | 696 | 1.8 | 4.4 |
| 149 | | specimen failed prematurely | | |
| 316 | 202 | 198 | 4.7 | 20.6 |
| 427 | | specimen failed prematurely | | |
| | | Al—10Ti—2Co | | |
| 24 | 471 | 420 | 8.9 | 19.0 |
| 149 | 361 | 334 | 3.1 | 7.8 |
| 316 | 194 | 189 | 6.1 | 24.1 |
| 427 | 111 | 104 | 10.1 | 21.4 |
| | | Al—10Ti—2Nb | | |
| 24 | 520 | 471 | 8.9 | 23.0 |
| 149 | 404 | 377 | 4.3 | 9.5 |
| 316 | 208 | 199 | 2.8 | 12.1 |
| 427 | 120 | 115 | 9.5 | 18.2 |
| | | Al—10Ti—2Mo | | |
| 24 | 523 | 462 | 5.4 | 13.0 |
| 149 | 386 | 352 | 4.3 | 10.4 |
| 316 | 210 | 190 | 6.2 | 14.1 |
| 427 | 123 | 117 | 9.2 | 19.7 |
| | | Al—10Ti—2Zr | | |
| 24 | 604 | 569 | 3.6 | 7.3 |
| 93 | 526 | 468 | 1.7 | 4.7 |
| 204 | 389 | 354 | 0.8 | 1.7 |
| 315 | 230 | 217 | 4.7 | 9.5 |
| 427 | 132 | 117 | 5.6 | 7.8 |
| 538 | 58 | 56 | 6.5 | 17.8 |
| | | Al—10Ti—1Si | | |

TABLE 4-continued

| Test Temp. (°C.) | U.T.S. (MPa) | Y.S. (MPa) | Elong. (%) | R.A. (%) |
|---|---|---|---|---|
| 24 | 658 | 607 | 1.0 | 2.0 |
| 93 | 558 | 553 | 3.5 | 6.0 |
| 204 | 407 | 405 | — | 8.5 |
| 315 | 295 | — | 3.0 | 21.0 |
| 427 | 155 | 154 | 5.0 | 35.0 |
| 538 | 80 | 70 | 3.0 | 17.0 |
| | | Al—10Ti—2Si | | |
| 24 | 647 | 611 | 3.0 | 4.7 |
| 149 | 476 | 461 | 3.0 | 8.7 |
| 316 | 285 | 277 | 4.0 | 7.1 |
| 427 | 165 | 160 | 9.0 | 18.2 |
| | | Al—10Ti—3Si | | |
| 24 | 714 | 674 | 1.5 | 1.5 |
| 93 | 585 | 581 | 2.0 | 2.0 |
| 204 | 422 | 418 | 1.0 | 5.0 |
| 315 | 239 | 223 | 2.5 | 13.5 |
| 427 | 128 | 122 | 3.5 | 19.5 |
| 538 | 46 | 40 | 2.0 | 3.5 |

An addition of about 0.1–4% of Co, Cr, Mn, Mo, Nb, Ni, Si, V and Zr provides improved strength at ambient and elevated temperature. Preferably, a total of about 1–3% strengthener is used for increased ambient and elevated temperature properties. However, the improved strength was accompanied by a loss in ductility.

Figure 3:
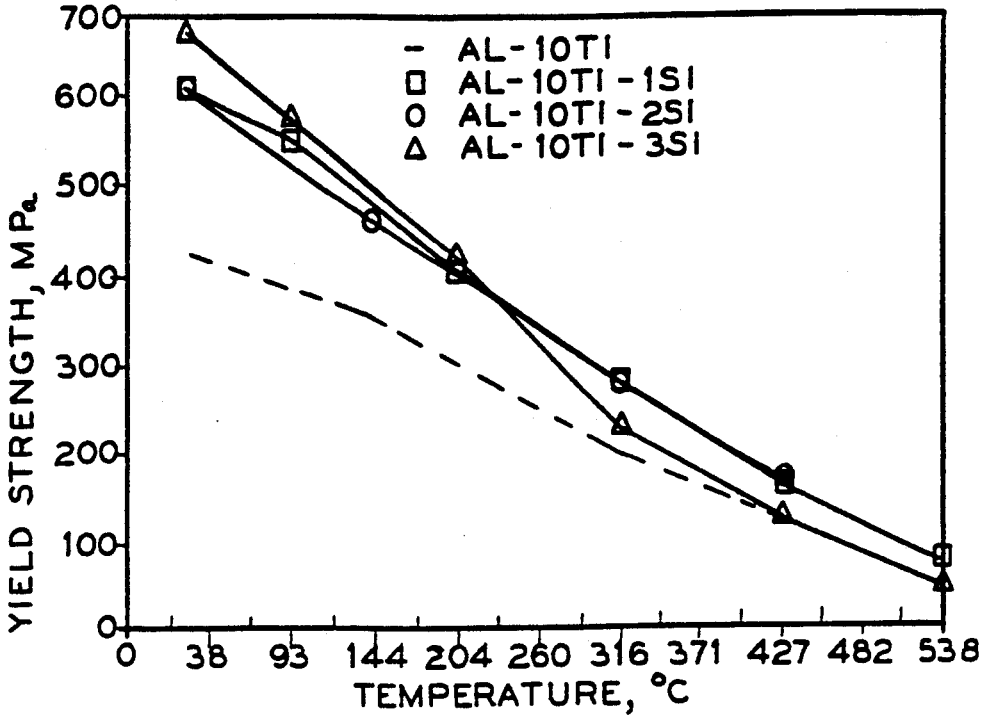
FIG. 3 is a plot of yield strength of MA Al-10Ti-Si alloys at temperatures between 24° and 538° C.
Figure 4:
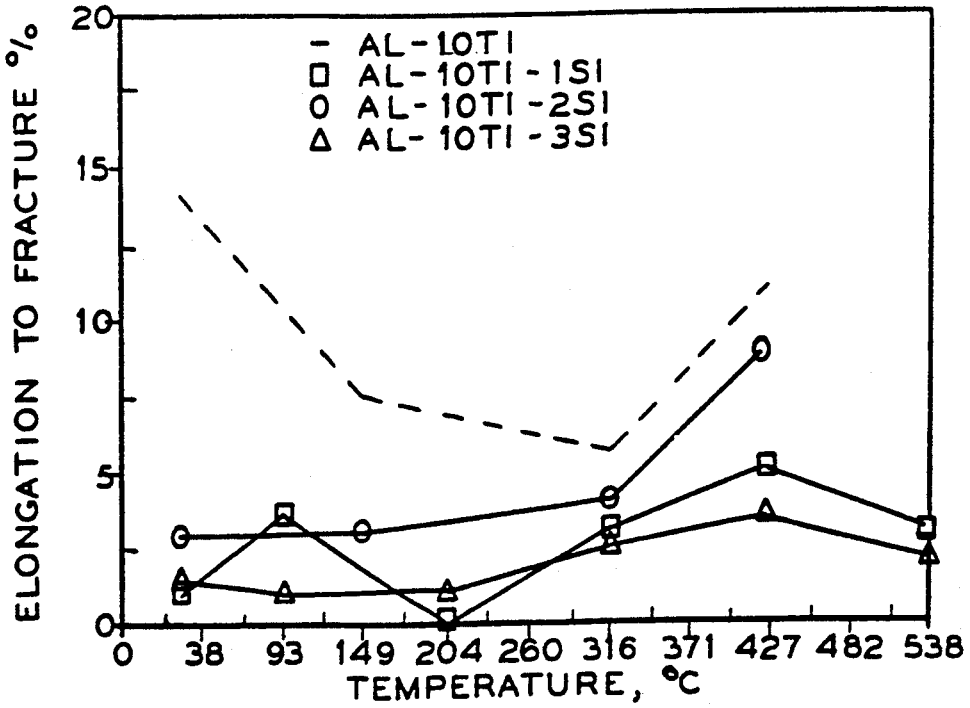
FIG. 4 is a plot of tensile elongation of MA Al-10Ti-Si alloys at temperatures between 24° and 538° C.

Si was the most effective strengthener. It is found that Si alters the lattice parameter of $Al_3Ti$ and it also forms a ternary silicide having the composition $Ti_7Al_5Si_{12}$. Preferably, about 1–3% Si is added to the MA aluminum-base matrix. A ternary addition of about 2 wt. % Si provided increased strengthening to 482° C. (see FIG. 3) with only a minimal decrease in ductility (see FIG. 4). This decrease in ductility does not rise to a level that would prevent machining and forming of useful components for elevated temperature applications.

In addition, the ternary strengthened alloys had high dynamic moduli. Modulus of elasticity at room temperature was determined by the method of S. Spinner et al., "A Method of Determining Mechanical Resonance Frequencies and for Calculating Elastic Modulus from the Frequencies," ASTM Proc. No. 61, pp. 1221–1237, 1961. The dynamic modulus is listed below in Table 5.

TABLE 5

| Alloy | Dynamic Modulus (GPa) |
|---|---|
| Al—10Ti | 96 |
| Al—12Ti | 103 |
| Al—10Ti—2Mn | 102 |
| Al—10Ti—2Cr | 101 |
| Al—10Ti—2V | 102 |
| Al—10Ti—2Ni | 102 |
| Al—10Ti—2Co | 101 |
| Al—10Ti—Nb | 99 |
| Al—10Ti—2Mo | 99 |
| Al—10Ti—2Si | 98 |
| Al—10Ti—2Zr | 99 |

In comparison to MA Al-10Ti, Al-10Ti in combination with a ternary strengthener provides increased modulus in addition to the increased high temperature properties. These high moduli values indicate that the alloys of the invention additionally provide good stiffness. Table 6 below compares MA Al-10Ti-2Si to state of the art high temperature aluminum alloys produced by rapid solidification.

TABLE 6

| Alloy | Ambient Temperature Yield Strength (MPa) | 427° C. Yield Strength (MPa) | Specific Modulus (cm × $10^6$) |
|---|---|---|---|
| MA Al—10Ti—2Si | 611 | 160 | 338 |
| FVS1212 (Al—12Fe—1V—2Si)* | 414 | 128 | 305 |
| Al—8Fe—7Ce** | 457 | 55*** | 292 |

*"Rabidly Solidified Aluminum Alloys for High Temperature/High Stiffness Applications", P.S. Gilman and S.K. Das, Metal Powder Report, September 1989, pp. 616–620.
**"Advanced Aluminum Alloys for High Temperature Structural Applications", Y.W. Kim, Industrial Heating, May 1988, pp. 31–34.
***Projected from 316° C. data As illustrated in Table 6, the alloy of the invention provides a significant improvement over the prior "state of the art" Al-Fe-X alloys. These improved properties increase the operating temperature and facilitate the use of lightweight aluminum-base alloys in more demanding applications.

Table 7 below contains specific examples of MA aluminum-base alloys within the scope of the invention (the balance of the composition being Al with incidental impurities). Furthermore, the invention contemplates any range definable by any two values specified in Table 7 or elsewhere in the specification and any range definable between any specified values of Table 7 or elsewhere in the specification. For example, the invention contemplates Al-6Ti-4Si and Al-9.7Ti-1.75Si.

TABLE 7

| Ti | Nb | Zr | Si | Mn | Cr | Mo | Ni | V |
|---|---|---|---|---|---|---|---|---|
| 6 | | | 4 | | | | | |
| 4 | 2 | | 4 | | | | | |
| 6 | | | .5 | .5 | .5 | .5 | .5 | .5 |
| 8 | | | 3 | | | | | |
| | 8 | | 3 | | | | | |
| | | 8 | | 1 | | 1 | | 1 |
| 6 | 2 | | 2 | | | | | |
| 8 | 1 | 1 | 1 | | | | | |
| 6 | 4 | | .1 | .1 | .1 | .1 | .1 | .1 |
| 6 | 2 | 2 | 2 | | | | | |
| 10 | | | 1 | 1 | | | | |
| 10 | | | 1 | | | | | 1 |
| 10 | | | 1 | 1 | | | | 1 |
| 10 | 4 | 2 | | | | | | |
| 10 | 2 | 2 | 2 | | | | | |
| 4 | 4 | 2 | | | | | | |
| 12 | | 2 | 2 | | | | | |
| 12 | | | .1 | | | | | |
| 12 | | | .5 | | | | | |

In addition, the invention includes adding up to about 4% oxidic material arising from deliberate additions of oxide materials. Oxides may be alumina, yttria or yttrium-containing oxide such as yttrium-aluminum-garnet. Advantageouslyy, 0 to about 4% yttria and most advantageously, 1 to about 3% yttria is added to the alloy. Furthermore, up to about 4% carbon originating from graphite (in addition to carbon originating MA process control agents) may be added to the alloy. Advantageously, less than about 3% graphite particles having a size less than a sieve opening of 0.044 mm are added to the alloy. It is also recognized that composite particles or fibers of SiC may be blended into the alloy. In addition, powder of the invention may be deposited by plasma spray technology with composite fibers or particles.

In conclusion, alloys strengthened by $Al_3X$ type phase are significantly improved by small amounts of ternary strengthener. The addition of a ternary strengthener greatly increases tensile and yield strength with an acceptable loss of ductility. The addition of silicon strengthener provides the best strengthening to 427° C. The alloys of the invention are formed simply by mechanically alloying with no rapid solidification or addition of composite whiskers or particles required. In addition, the tensile properties, elevated temperature properties, and specific modulus of the ternary stiffened MA aluminum-base titanium alloy are significantly improved over the similar prior art alloys produced by rapid solidification, composite strengthening or mechanical alloying.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A MA aluminum-base alloy having improved high temperature properties at temperatures up to about 482° C. consisting essentially of by weight percent of total of about 6–12% X, wherein X is contained in an intermetallic phase in the form of $Al_3X$ and X is at least one selected from the group consisting of Nb, Ti and Zr, about 0.1–4% Si.

2. The alloy of claim 1 where X is Ti.

3. The alloy of claim 1 wherein said intermetallic phase contains about 8–11% Ti.

4. The alloy of claim 1 wherein said Si is about 1–% of the MA aluminum-base alloy.

5. A MA aluminum-base alloy having improved high temperature properties at temperatures up to about 482° C. consisting essentially of by weight percent a total of about 6–12% X, wherein X is contained in an intermetallic phase in the form of $Al_3X$ and X is at least one selected from the group consisting of Nb, Ti and Zr, about 0.1–4% Si, up to 4% oxidic material and up to 4% carbon.

6. The alloy of claim 5 wherein said alloy contains up to about 4% oxidic material selected from the group consisting of alumina, yttria and yttrium-aluminum-garnet.

7. The alloy of claim 5 wherein said alloy contains up to about 4% carbon originating from graphite.

8. A MA aluminum-base alloy having improved elevated temperature properties at temperatures up to about 482° C. consisting essentially of by weight percent about 8–11% Ti, said Ti being contained in intermetallic $Al_3Ti$ phase, about 1–3% Si for increased elevated temperature strength, about 1–4% C, about 0.1–2% O, said C and O being contained in the form of aluminum compound dispersoids for stabilizing grains of the MA aluminum-base alloy, and up to about 4% oxidic material in addition to said oxygen contained in said aluminum compound dispersoids.

9. The alloy of claim 8 wherein said aluminum-base alloy contains about 0.7–1% O and about 1.2–2.3% C.

10. The alloy of claim 8 wherein said oxidic material is selected from the group consisting of alumina, yttria and yttrium-aluminum-garnet.

11. The alloy of claim 8 wherein said oxidic material is yttria.

12. The alloy of claim 8 wherein said alloy up to about 3% carbon originating from graphite in addition to carbon content specified in claim 9.

* * * * *

UNITED STATES PATENT AND TRADEMARK OFFICE

CERTIFICATE OF CORRECTION

PATENT NO. : 5,169,461

DATED : DEC. 8, 1992

INVENTOR(S) : ARUNKUMAR S. WATWE, PRAKASH K. MIRCHANDANI, WALTER E. MATTSON, RAYMOND C. BENN

It is certified that error appears in the above-identified patent and that said Letters Patent is hereby corrected as shown below:

Title page, the heading entitled "[75] Inventors" should include

--Raymond C. Benn, Madison, Conn.--

Signed and Sealed this

Nineteenth Day of October, 1993

Bruce Lehman

*Attest:*

BRUCE LEHMAN

*Attesting Officer*

*Commissioner of Patents and Trademarks*